US005268662A

United States Patent [19]

Uetsuhara et al.

[11] Patent Number: 5,268,662

[45] Date of Patent: Dec. 7, 1993

[54] PLUNGER TYPE ELECTROMAGNET

[75] Inventors: Tokio Uetsuhara; Yuichi Ando; Kenji Iio; Kenichiro Kinoshita, all of Tokyo, Japan

[73] Assignee: Mitsubishi Mining & Cement Co., Ltd., Japan

[21] Appl. No.: 919,588

[22] Filed: Jul. 24, 1992

Related U.S. Application Data

[62] Division of Ser. No. 787,008, Nov. 4, 1991, abandoned.

[30] Foreign Application Priority Data

| | | | |
|---|---|---|---|
| Aug. 8, 1988 | [JP] | Japan | 63-197581 |
| Aug. 30, 1988 | [JP] | Japan | 63-112728 |
| Sep. 12, 1988 | [JP] | Japan | 63-226351 |
| Nov. 15, 1988 | [JP] | Japan | 63-286816 |
| Dec. 20, 1988 | [JP] | Japan | 63-319631 |
| Jan. 9, 1989 | [JP] | Japan | 1-001149 |
| Jan. 20, 1989 | [JP] | Japan | 1-004434 |

[51] Int. Cl.[5] ..... H01F 7/00; H01F 7/08

[52] U.S. Cl. ..... 335/229; 335/230

[58] Field of Search ..... 335/179, 220, 229-235

[56] References Cited

U.S. PATENT DOCUMENTS

| | | | |
|---|---|---|---|
| 4,419,643 | 12/1983 | Ojima | 335/234 |
| 4,604,599 | 8/1986 | Koehler | 335/230 |
| 4,782,315 | 11/1988 | Bataille | 335/234 |

*Primary Examiner*—Leo P. Picard
*Assistant Examiner*—Raymond Barrera
*Attorney, Agent, or Firm*—Bierman and Muserlian

[57] ABSTRACT

A plunger type electromagnet is provided with an attractive plate connected to the plunger, with an improved configuration of plunger and stationary element, or with a flanged tubular member of magnetic material affixed to the axial end of a coiling bobbin, in order to increase the rate of change in the permeance of the magnetic circuit at the time of attractive operation and to enhance the sensitivity of the electromagnet.

Furthermore, the surface area of the abutment faces of the stationary and movable elements is calibrated so as to control the attractive and retaining force thereof.

In some embodiments, a permanent magnet is provided which is shaped in the form of an annulus and is magnetized in the direction of thickness of the annulus, so as to facilitate magnetization of the permanent magnet, to reduce the number of component parts, and to provide an electromagnet which is compact in size, light in weight, and suitable for mass production.

1 Claim, 12 Drawing Sheets

PLUNGER TYPE ELECTROMAGNET

This is a division of Ser. No. 787,008 filed Nov. 4, 1991, now abandoned.

TECHNICAL FIELD

This invention relates to a plunger type electromagnet for use in solenoid valve and the like for controlling the flow of fluid such as air, water, fuel and the like.

BACKGROUND ART

The plunger type electromagnet is designed 1) to make use of electromagnetic attractive force acting on a movable element upon energization of a coil wound around a stationary element of magnetic substance.

Also, 2) there has been used the so-called "latching type" electromagnet wherein the magnetomotive force generated by energization of a coil and the magnetomotive force by a permanent magnet are allowed to act in series on the plunger of magnetic substance.

The above-mentioned plunger type electromagnet, however, suffers from the following disadvantages.

(1) It inherently requires the presence of a gap between a yoke and the plunger, so that a large ampere-turn is required to magnetize across such a gap. Particularly, the latching type electromagnet requires a larger ampere-turn because a permanent magnet having a large magnetic reluctance is inserted in series in the magnetic circuit developed by coil energization. This entails to enlarge the size of the electromagnet.

(2) There is another disadvantage in that the magnetic attractive force at the gap acts in a given direction along the circumference of the plunger because of the fluctuation in the magnetic flux density as viewed in the circumferential direction of the plunger, whereby the operating frictional resistance of the plunger is increased.

(3) In combination with the condition as set forth in (1) above, in the case of an electromagnet of the type in which the coil must be kept energized as long as the attractive force is to be applied, power consumption is increased accordingly.

(4) Due to deviation in the machining accuracy during mass production of electromagnets, in the material property or in the spring force and the like, there is a likelihood that under the action of the residual magnetic flux, the plunger is not released away from the stationary element even after electric current to the coil is cut off.

(5) With respect to the electromagnet of the type providing the latching function in which the plunger is retained under the action of a permanent magnet even after the power supply to the coil is cut off, there is a need for an electromagnet wherein such a permanent magnet is omitted in order to reduce the production cost, as long as the same latching function is performed in the absence of a permanent magnet.

(6) In the conventional electromagnet, the differential coefficient of the permeance, at the moment where the plunger is attracted toward the stationary element, as differentiated along the direction of movement of the plunger is so small that it is unable to obtain a relatively large initial attractive force.

(7) In the latching type electromagnet in which an annular magnet is employed as a permanent magnet, it has customarily been necessary to magnetize the annular permanent magnet in the radial direction thereof. Magnetization of the annular permanent magnet in such a direction is difficult because of large difference in surface area between the outer and inner peripheries of the annular magnet. For this reason, it has been necessary to divide the annulus into a plurality of sectoral segments. This has resulted in a poor volumetric ratio of the annular permanent magnet, bulky size of the electromagnet, increase in the number of component parts, and low productivity.

DISCLOSURE OF INVENTION

The present invention is contemplated to solve the foregoing problems encountered during use of the plunger type electromagnet and has for its object to provide a plunger type electromagnet which is high in sensitivity, small in power consumption, compact in size, and light in weight, and which is feasible to meet the needs required by the user.

Findings underlying the present invention will be described below.

(1) Provided that the ampere-turn of a magnetic circuit is constant, the attractive force of the electromagnet is proportional to the differential coefficient of the permeance P between the plunger and the stationary element, as differentiated along the direction of movement of the plunger.

(2) When the gap being present in the magnetic circuit is small and magnetic pole pieces are held in tight contact with each other, it is considered that the quantity of magnetic flux is roughly constant if the ampere-turn of the magnetic circuit is constant. Accordingly, the smaller the surface area of the abutment face between the magnetic pole pieces is, the greater the attractive force can be, as long as the magnetic flux density B does not become saturated.

(3) The magnetic reluctance of a magnetic circuit is inversely proportional to the cross-sectional area thereof.

Based on the foregoing findings, this invention is comprised of the following solutions in combination and has for its object to reduce the capacity of electric source required for the electromagnet, to render the electromagnet compact, and to reduce the production cost.

i) By means such as provision for an attractive plate on a magnetic pole piece and improvements in the configuration of the abutment face between the magnetic pole pieces, the magnetic reluctance of the magnetic circuit is reduced as well as the permeance of the circuit increased so as to obtain a larger attractive force for a predetermined ampere-turn.

ii) The abutment surface area between the magnetic pole pieces is calibrated in such a manner that the attractive force therebetween is increased.

iii) The permanent magnet in the form of an annulus is magnetized in the direction of thickness.

Structural features of the present invention are given below.

(a) An attractive plate made from a magnetic substance and having an opposing flat face larger than the outer diameter of the plunger is provided at an end of the plunger opposite the stationary element in such manner as to oppose that end face of the yoke which intersects at a right angle the axis of the plunger, with the axial length of the plunger being selected to be a predetermined value.

(b) The axial length of the plunger is such that, when the plunger is not attracted by the electromagnet, the distance of spacing between the attractive plate and the opposite end face of the yoke is equal to the distance of spacing between the plunger and the stationary element.

(c) The axial length of the plunger is such that, when the plunger is attracted by the electromagnet, the attractive plate abuts against the opposing end face of the yoke and a small gap is held between the abutment faces of the plunger and the stationary element.

(d) The axial length of the plunger is such that, when the plunger is attracted by the electromagnet, the abutment faces of the plunger and the stationary element abut against each other and a small gap is held between the attractive plate and the end face of the yoke.

(e) The attractive plate is fit on the plunger for limited swinging movement.

(f) Those magnetic pole faces of the plunger and the stationary element which are attracted with each other are designed and configured such that the magnetic pole face at the side of the plunger is formed with a plurality of truncated cones arranged in a tapered stepped fashion and positioned one on the other coaxially with the plunger and the magnetic pole face at the side of the stationary element is formed, for engagement with the magnetic pole face of the plunger, with a plurality of stepped depressions adapted to loosely fit over the truncated cones of the plunger.

(g) A flanged tubular member made from a magnetic substance is inserted in and affixed to one or both of open ends of a bobbin.

(h) A pair of magnetic pole pieces, each of which is made by cutting an integral structure comprised of the yoke, stationary element and plunger along a plane perpendicular to the axis of the plunger to provide one such magnetic pole piece at the side of the stationary element, are combined so as to abut against each other along the plane of cutting to provide a stationary magnetic pole piece and a movable magnetic pole piece. A coil is fixedly mounted to the stationary magnetic pole piece while a spring is mounted between the stationary and movable magnetic pole pieces.

(i) In the electromagnet as set forth in feature (h) above, the surface area of the abutment face of the movable magnetic pole piece which abuts against the stationary magnetic pole piece is reduced to a predetermined value.

(j) In the electromagnet as set forth in feature (h) above, the stationary magnetic pole piece is provided with a tubular magnetic pole piece which circumscribes the stationary magnetic pole piece and moveably receives the movable magnetic pole piece, the arrangement being such that the tubular magnetic pole piece loosely receives the outer surface at an end of the movable magnetic pole piece even when the movable magnetic pole piece is spaced away from the stationary magnetic pole piece.

(k) In the electromagnet as set forth in features (h), (i) and (j) above, the arrangement is such that the plunger and the stationary element are retained to adhere to each other only by the residual magnetic flux of the core elements of the electromagnet when electric current to the coil is cut off, and that the plunger is released away from the stationary element upon feeding electric current to the coil in the reverse direction.

(l) The inner face of the yoke and one of the magnetic pole faces of the plunger are arranged to face with each other parallel to the direction of movement of the plunger, and the other of the magnetic pole faces of the plunger is arranged to face perpendicular to the direction of movement of the plunger with a magnetic pole face having a larger cross-sectional area than that of the stationary element.

(m) In the electromagnet as set forth in feature (l) above, the other magnetic pole face of the plunger and the magnetic pole face of the stationary element facing the other magnetic pole face are designed to form tapered projection and depression which fit with each other.

(n) A magnetic pole face, located on or coupled to an end face of the yoke, and one of the magnetic pole faces of the plunger are arranged to face with each other perpendicular to the direction of movement of the plunger, the magnetic pole face located on or coupled to the end face of the yoke being designed to present a cross-sectional area larger than that of the stationary element, the magnetic pole face of the stationary element and the other of the magnetic pole faces of the plunger being arranged to face with each other parallel to the direction of movement of the plunger.

(o) In the electromagnet as set forth in feature (n) above, the magnetic pole face located on or coupled to the end face of the yoke and the one of the magnetic pole faces of the plunger are designed to form tapered projection and depression which fit with each other.

Next, with respect to the plunger type electromagnet of the latching type, the following features are applicable.

(p) The permanent magnet is shaped in the form of an annulus, is arranged coaxially with the plunger so as to surround the plunger, and is magnetized in the direction of thickness of the annulus.

(q) The permanent magnet as set forth in feature (p) above is inserted between a magnetic pole piece provided on the end face of the yoke opposite the stationary element, on the one hand, and an annular magnetic pole piece arranged coaxially with and so as to surround the plunger on the end face of the coil directed to the first-mentioned magnetic pole piece, on the other hand.

(r) Two such electromagnets as set forth in feature (q) above are combined symmetrically by being abutted with each other with the magnetic pole piece on the end face of the yoke situated therebetween, the two plungers being merged into a single common plunger, the ends of the common plunger having a reduced diameter as compared with the central part thereof, the stationary elements on both sides having a bore for moveably receiving the reduced diameter portions of the plunger, the spring being omitted.

(s) The magnetic pole piece provided on the end face of the yoke opposite the stationary element is inserted within the yoke, with the plunger extending through the magnetic pole piece, an attractive plate being provided at an end of the plunger opposite the stationary element in such manner that the attractive plate intersects the plunger axis at a right angle and inscribes the inner face of the yoke, the length of the plunger being such that the face of the attractive plate is in registration with the end face position of the yoke when the plunger is not attracted to the stationary element, the permanent magnet as set forth in feature (p) above being arranged between the attractive plate and the magnetic pole piece.

(t) In the electromagnet as set forth in feature (s) above, the permanent magnet is arranged between the magnetic pole piece and the coil and an annular magnetic pole piece is arranged between the permanent magnet and the coil coaxially with the plunger so as to surround the plunger.

(u) There are provided: an attractive plate arranged at an end of the plunger opposite the stationary element in such manner as to intersect the plunger axis at a right angle and to inscribe the inner face of the yoke; a permanent magnet annular in form which is arranged coaxially with the attractive plate at the side of the attractive plate opposite the plunger and which is magnetized in the direction of thickness of the annulus; and, an annular magnetic pole piece arranged coaxially with the attractive plate at the side of the permanent magnet opposite the attractive plate. The length of the plunger is such that the face of the annular magnetic pole piece is in registration with the end face position of the yoke when the plunger is not attracted to the stationary element.

As set forth hereinbefore, the present invention is made based on the well known findings and it provides dominant advantageous effects and contributes in many respects to a wide variety of civil and industrial fields.

That is, (a) With an electric power equivalent to the same ampere-turn as used hitherto, it is possible to generate an attractive force which is several times of what is obtainable with the conventional device.

(b) With an electric power equivalent to a fraction of the ampere-turn used in the conventional device, it is possible to generate the same attractive force as in the prior art.

(c) It is possible to readily manufacture those electromagnets having various functions such as monostable and bistable functions.

From the foregoing properties, the following specific characteristics are obtainable.

(1) It is possible to enhance the sensitivity and to save energy.

(2) The electromagnet may be made compact in size and light in weight.

(3) It is possible to control the magnetic remanence.

(4) The product is simple in structure and suitable for mass production.

BEST MODE FOR CARRYING OUT THE INVENTION

Figure 22:
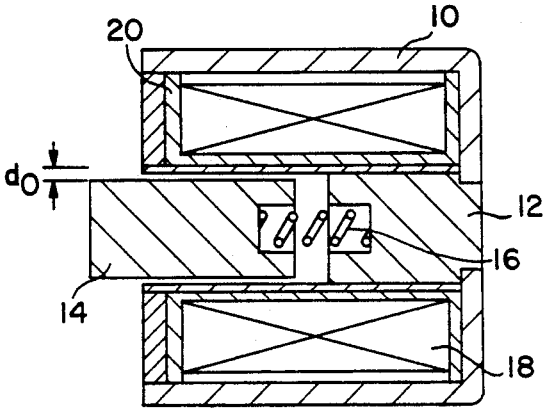

First, the prior art will be described with reference to the accompanying drawings. Referring to FIG. 22 wherein the conventional device without a permanent magnet is shown, the electromagnet includes a stationary element 12 fixed to a yoke 10, a plunger 14 adapted to abut against the stationary element 12, a spring 16 for spacing the stationary element 12 and the plunger 14 away from each other by a predetermined distance, a coil 18 for magnetizing, upon energization, a magnetic circuit comprised of the stationary element 12, the plunger 14 and the yoke 10 and for attracting the plunger 14 against the bias of the spring 16 to cause it to adhere to the stationary element 12, and a bobbin for winding the coil. FIG. 22 illustrates the rest position in which the coil 18 is de-energized and wherein the plunger 14 is spaced away from the stationary element 12 by the bias of the spring 16. Upon energization of the coil 18, the plunger 14 will be attracted toward the stationary element 12 against the bias of the spring 16, to operate a contact or a valve (not shown) and the like connected to the plunger 14. Upon de-energization of the coil 18, the plunger will be returned to the position shown in FIG. 22.

Figure 23:
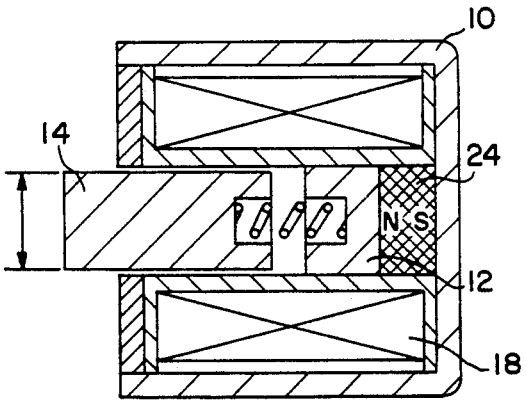
Figure 25:
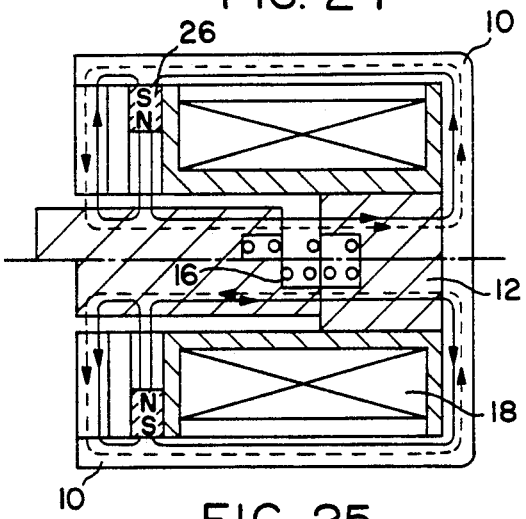

FIGS. 23 and 25 illustrate examples of the conventional devices wherein a permanent magnet is provided. In addition to the stationary element 12, a permanent magnet 24 or an annular permanent magnet 26 is employed in combination. In FIG. 23, there is shown the rest position in which the coil 18 is de-energized and wherein the plunger 14 is spaced away from the stationary element 12 by the bias of the spring 16. Upon supplying electric current to the coil 18 in such a direction that magnetomotive force having the polarity identical to that of the magnetomotive force by the permanent magnet 24 is induced by the coil, the plunger 14 will be attracted under the combined action of both magnetomotive forces toward the stationary element 12 against the bias of the spring 16 to operate a contact or a valve (not shown) and the like connected to the plunger 14. This condition is maintained only under the action of the permanent magnet 24 even when the coil 18 is de-energized. The so-called "latching" function continues until the electric current is supplied to the coil 18 in such a direction that magnetomotive force having the polarity opposite to that of the magnetomotive force by the permanent magnet 24 is induced by the coil, whereupon the plunger returns to the position shown in FIG. 23.

Figure 24:
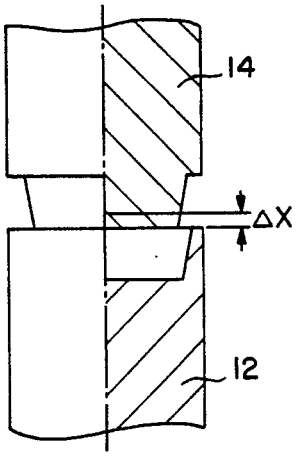

FIG. 24 illustrates an example of the conventional abutment faces of the stationary element 12 and the plunger 14.

In FIG. 25, the part above the center line indicates the plunger 14 as spaced away from the stationary element 12, while the part below the center line designates the plunger 14 as attracted to the stationary element. The solid line denotes the line of magnetic force generated by the permanent magnet, while the broken line indicates the line of magnetic force developed by energization of the coil.

The present invention is contemplated to overcome the problems encountered in the conventional plunger type electromagnets described above. The embodiments of the invention will now be described with reference to the drawings.

Figure 1:
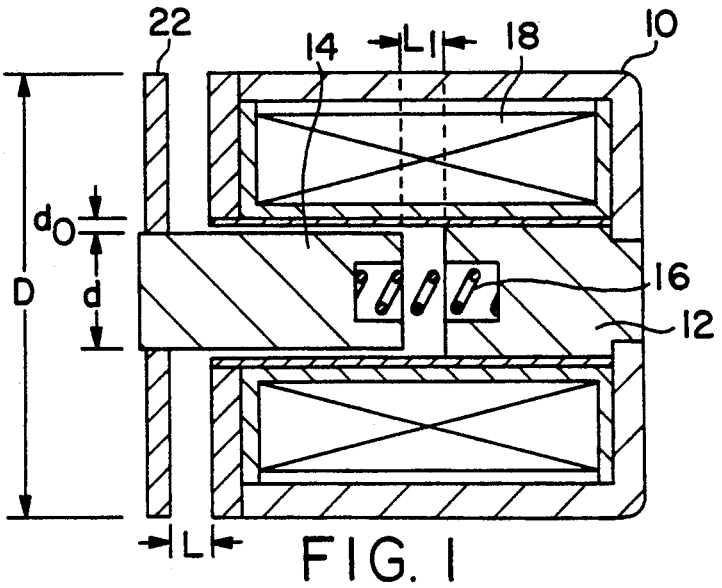
FIGS. 1–3 are cross-sectional views showing various embodiments of the plunger type electromagnet of the class wherein an attractive plate is provided according to the invention.

Referring to FIG. 1, an attractive plate 22 is provided at an end of the conventional plunger 14 opposite the stationary element 12. The arrangement is such that, when the coil 18 is de-energized, the distance L between the attractive plate 22 and the yoke 10 is equal to the distance $L_1$ between the plunger 14 and the stationary element 12.

Assuming that, in FIG. 1, d is the outer diameter of the plunger, $d_o$ is the gap between the yoke and the plunger, D is the outer diameter of the attractive plate, L is the distance between the attractive plate and the yoke, and, $K_1$ is a proportional constant, then the permeance P between the attractive plate and the yoke is expressed by the formula $$P \div K_1\pi(D^2-d^2)/L \quad (1)$$

Accordingly, it will be noted that it is possible to remarkably improve the permeance P by selecting values so that $D>d$.

Furthermore, the quantity of magnetic flux $\phi$ is constant if the magnetizing ampere-turn is constant. Assuming that, in FIG. 1, S is the cross-sectional area of the plunger, the attractive force F is given by the formula $$F=K_2\,\phi^2/S \quad (2)$$

By selecting values so that, in the formula (1), $D=2d$ to $3d$, and $L=4d_o$ to $10d_o$, the permeance P between the yoke and the plunger is remarkably improved by the provision of the attractive plate. As a result, a greater magnetic flux is induced upon energization of the coil, so as to in turn increase the attractive force between the plunger and the stationary element, as well as to further enhance the sensitivity of the electromagnet due to the combined action of the electromagnetic attractive force that is exerted between the yoke and the plunger in the axial direction of the plunger.

Additionally, the electromagnetic attractive force in the circumferential direction of the plunger is decreased whereby the frictional resistance in the axial direction of the plunger is reduced.

Figure 2:
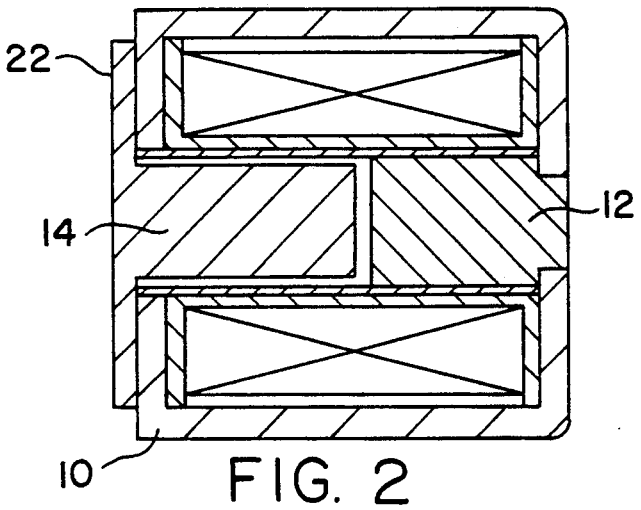

FIG. 2 shows another embodiment which is designed so that, in the operative position of the electromagnet, the attractive plate 22 is brought in contact with the yoke 10 but a gap is held between the plunger 14 and the stationary element 12.

In the case of the electromagnet designed so that, in the operative position of the electromagnet, the attractive plate 22 is brought into contact with the yoke 10 as shown in FIG. 2, the ratio of the surface area of the plunger 14 with respect to that of the attractive plate 22 is:

$$d^2/(D^2-d^2) \quad (3)$$

It will be noted that, therefore, the attractive force due to the magnetic remanence is greatly reduced as compared with the electromagnet without an attractive plate as shown in FIG. 22.

In the conventional electromagnet, as the spring 16 becomes deteriorated during use, there is a likelihood that due to residual magnetic flux, the plunger 14 is prevented from being released away from the stationary element 12 even after de-energization of the coil 18. This gives rise to the danger that, in the case of the solenoid valve for gas applications, gas is inadvertently allowed to issue. According to the embodiment shown in FIG. 2, it is possible to design such that the residual magnetic flux is limited. This ensures that the plunger 14 is released away from the stationary element 12 even in the event of spring deterioration.

Figure 3:
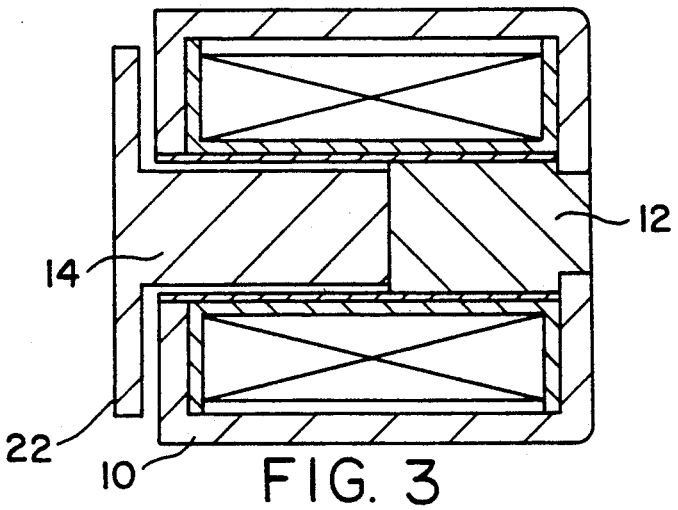

FIG. 3 shows another embodiment which is arranged so that, in the operative position of the electromagnet, the plunger 14 is brought into contact with the stationary element 12 but a gap is held between the attractive plate 22 and the yoke 10.

In the electromagnet shown in FIG. 3, it is possible to increase the attractive force resulting from the residual magnetic flux of the core elements as the coil 18 is de-energized, because in the above formula (3), $D>d$. In contrast to the conventional electromagnet shown in FIG. 22, this embodiment is able to keep the plunger to be sufficiently strongly adhered to the stationary element 12 only by the residual magnetic flux. It will be understood that, by applying this arrangement to the latching type electromagnet shown in FIG. 23, it is possible to omit the permanent magnet 24.

In this manner, with the arrangements shown in FIGS. 2 and 3, it is possible to control the attractive force that is developed between the plunger and the stationary element due to the residual magnetic flux.

Figure 4:
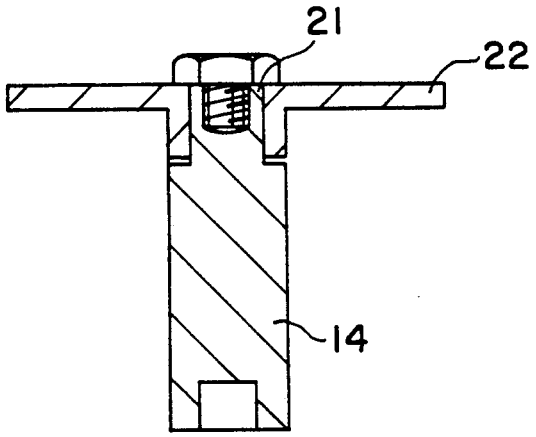
FIG. 4 is a cross-sectional view illustrating the attractive plate according to the invention as affixed to the plunger.

FIG. 4 illustrates the mode of connection between the attractive plate 22 and the plunger 14. As shown, the attractive plate 22 is affixed by a screw to the plunger 14 by way of an O-ring 21 for limited swinging movement with respect thereto. With this arrangement, the plunger is brought into tight contact with the stationary element and the yoke when the coil is energized, whereby the reluctance of the magnetic circuit is reduced. This arrangement also permits to lower the machining accuracy of the plunger with respect to the stationary element and the yoke, so that the production cost of electromagnet may be reduced.

Figure 5:
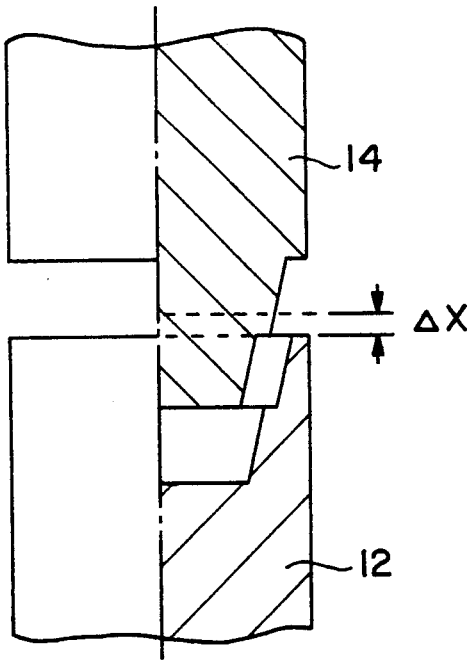
FIG. 5 is a cross-sectional view showing the abutment faces of the stationary element and the plunger according to the invention.

FIG. 5 shows another embodiment of the invention wherein the configuration of the abutment faces of the plunger 14 and the stationary element 12 is improved so as to enhance the sensitivity. Assuming that, in FIG. 5, U is the magnetizing ampere-turn, x is the length of the gap as measured in the direction of movement of the plunger, and, F is the attractive force, the attractive force F is expressed by the formula $$F = \frac{1}{2} U^2 \frac{dP}{dx} \tag{4}$$

Accordingly, assuming that the ampere-turn of the magnetic circuit is constant, it will be noted that the attractive force F is proportional to the differential coefficient of the permeance P as differentiated with respect to the gap length x in the vicinity of the illustrated position ($\Delta x$) between the plunger 14 and the stationary element 12. Therefore, by designing the abutment faces of the plunger 14 and the stationary element 12 as shown in FIG. 5, the differential coefficient may be increased so as to in turn increase the attractive force. It will be appreciated that, in contrast to the conventional configuration shown in FIG. 24, a greater attractive force may be developed by the configuration shown in FIG. 5.

Figure 6C:
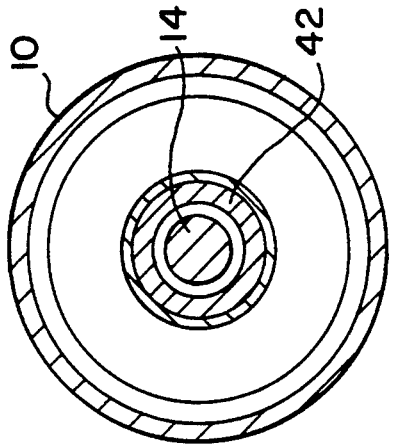
FIG. 6 is a cross-sectional view illustrating an improved form of the bobbin according to the invention.
Figure 6B:
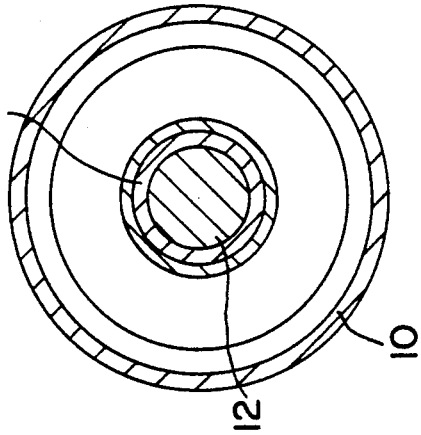
Figure 6A:
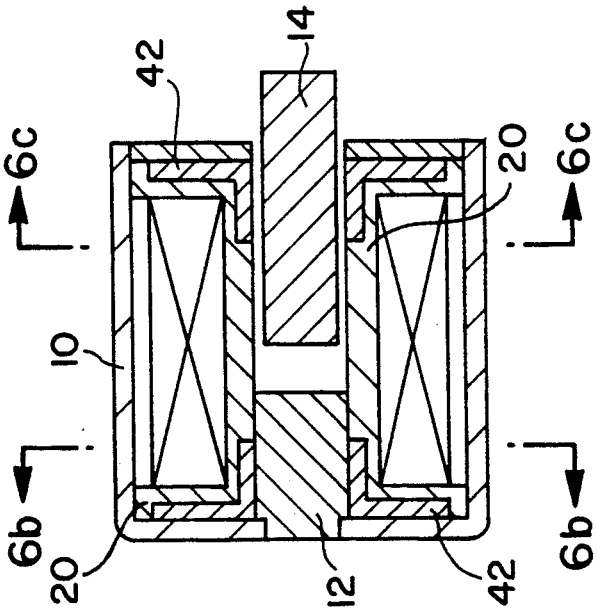

FIG. 6 shows another embodiment in which a flanged tubular member 42 made from a magnetic substance is inserted in and affixed to each of the open ends of the bobbin 20 in order to increase the cross-sectional area of the magnetic path to thereby decrease the magnetic reluctance and enhance the sensitivity of the electromagnet.

More specifically, the magnetic reluctance R of a magnetic circuit is inversely proportional to the cross-sectional area S thereof:

$$R = K_2/S \tag{5}$$

Feature of the embodiment shown in FIG. 6 is that the cross-sectional area S is enlarged. FIG. 6(*a*) is a cross-sectional view thereof, FIG. 6(*b*) is a cross-sectional view taken along the line B—B of FIG. 6(*a*), and FIG. 6(*c*) is a cross-sectional view taken along the line C—C of FIG. 6(*a*).

Figure 7A:
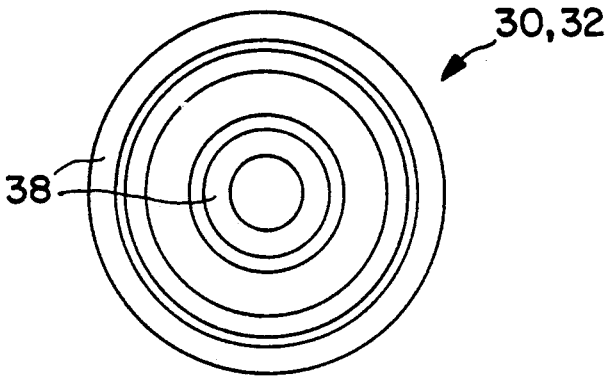
FIG. 7 is a cross-sectional view showing the first embodiment of the core structure for the plunger type electromagnet according to the invention.
Figure 7B:
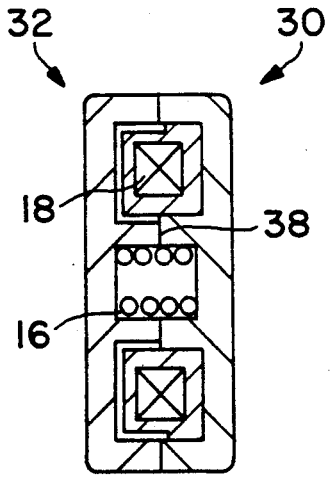
Figure 7C:
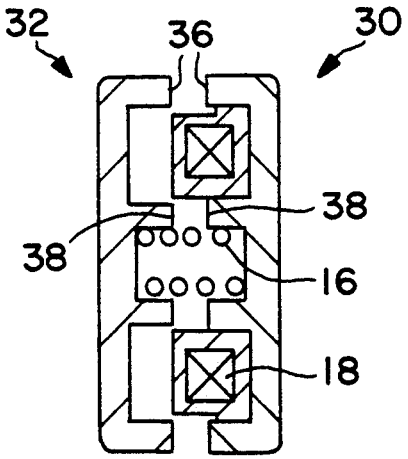

FIG. 7 illustrates another embodiment of the electromagnet wherein a pair of magnetic pole pieces, each of which is made by cutting an integral structure comprised of the yoke, stationary element and plunger along a plane perpendicular to the axis of the plunger to provide one such magnetic pole piece at the side of the stationary element, are combined so as to abut against each other along the plane of cutting to provide a stationary magnetic pole piece and a movable magnetic pole piece. FIG. 7(*a*) is a plan view showing the abutment face between the two pole pieces, and FIGS. 7(*b*) and 7(*c*) are cross-sectional views showing, respectively, the pole pieces as attracted together and the pole pieces as released from each other.

More specifically, the electromagnet shown in FIG. 7 includes a stationary magnetic pole piece 30 comprised of two tubular concentric cores of the same height and a movable magnetic pole piece 32 identically shaped, with these magnetic pole pieces being combined to abut along the abutment face 38. The coil 18 and the spring 16 are mounted between the stationary pole piece 30 and the movable pole piece 32, with the coil 16 being fixed to the stationary pole piece 30. In the electromagnet shown in FIG. 1, the presence of the clearance $d_o$ between the yoke 10 and the plunger 14 is unavoidable for the purposes of manufacture. Also, from the view point of manufacturing accuracy, it is impossible for the purposes of mass production to ensure that $L-L_1=0$. This embodiment overcomes these problems by designing the electromagnet such that any unnecessary clearance or gap in the magnetic path is eliminated in order to reduce the magnetic reluctance. Accordingly, an electromagnet is obtainable in which only a small ampere-turn is required to retain the movable magnetic pole piece 32.

Figure 8A:
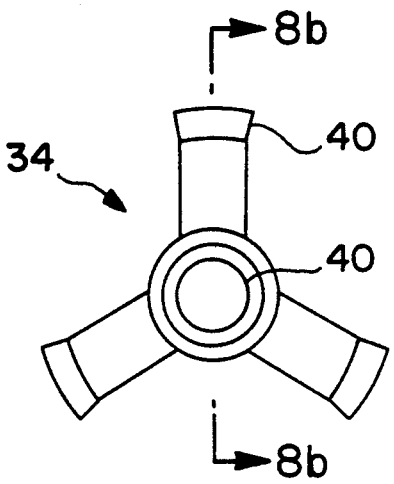
FIG. 8 is a cross-sectional view illustrating the second embodiment of the core structure which is made by reducing the abutment surface area of the magnetic pole piece of the electromagnet shown in FIG. 7.
Figure 8B:
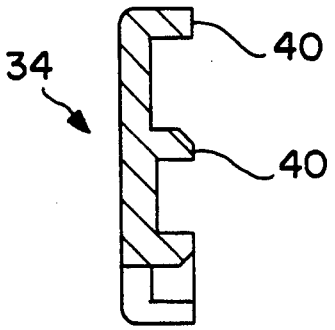

FIG. 8 shows a modified form of the movable magnetic pole piece 32 shown in FIG. 7. FIG. 8(*a*) is a plan view showing the abutment face of the movable magnetic pole piece 40 that abuts against the stationary magnetic pole piece and FIG. 8(*b*) is a cross-sectional view taken along the line A—A of FIG. 8(*a*).

Assuming that, $F_c$ is the attractive force,

B is the density of magnetic flux at the abutment face of the magnetic pole piece, $S_c$ is the surface area of the abutment face, and, $\phi$ is the quantity of magnetic flux induced, the following equation is established:

$$Fc = \frac{10^7}{8\pi} \times B^2 Sc = \frac{10^7}{8\pi} \times \frac{\phi^2}{Sc} \tag{6}$$

In the case that a gap does not exist in the magnetic circuit so that the magnetic pole pieces are held in tight contact with each other, it is considered that the quantity of magnetic flux $\phi$ is roughly constant if the ampere-turn of the magnetic circuit is constant. Accordingly, from the above equation, it will be understood that, the smaller the surface area $S_c$ is, the greater the attractive force $F_c$ can be.

It will be noted that the feature of the embodiment shown in FIG. 8 is that the abutment surface area of the movable magnetic pole piece 40 is reduced. Accordingly, it is possible to increase the attractive force F as well as to reduce the weight of the core element.

Figure 9:
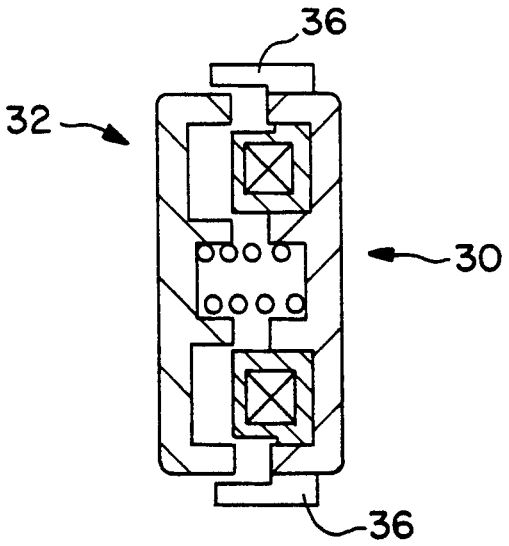
FIG. 9 is a cross-sectional view showing the third embodiment of the core structure shown in FIG. 7.

FIG. 9 illustrates another modified embodiment wherein a tubular magnetic pole piece 36 is mounted to the stationary magnetic pole piece 30 of the electromagnet shown in FIG. 7. The arrangement is such that the tubular magnetic pole piece 36 loosely circumscribes the outer surface at an end of the movable magnetic pole piece 32 even when the movable magnetic pole piece 32 is spaced away from the stationary magnetic pole piece 30. With this arrangement, the reluctance of the magnetic circuit against the magnetomotive force generated upon energization of the coil is so small that it is possible to develop a sufficiently strong attractive force between the movable magnetic pole piece 32 and the stationary magnetic pole piece 30 even with a small ampere-turn.

Figure 10A:
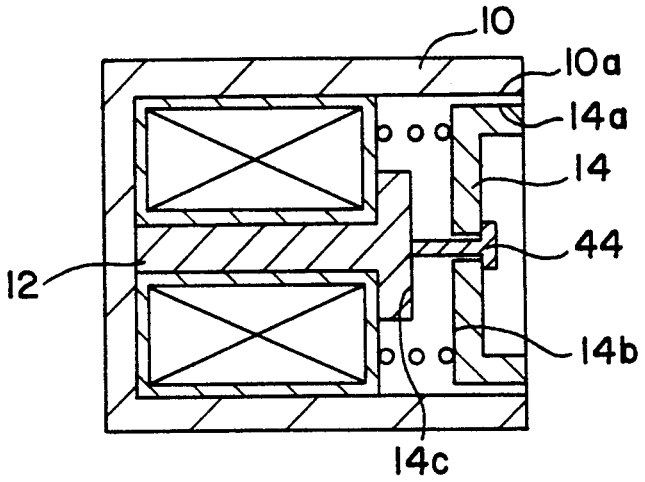
FIG. 10 is a cross-sectional view showing the first embodiment of the electromagnet of the class wherein the abutment faces of the plunger and the stationary element are enlarged according to the invention.
Figure 10B:
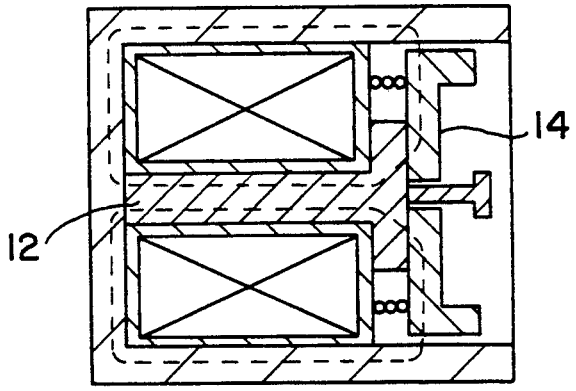

FIG. 10 illustrates an embodiment which is designed to enlarge the surface area of the opposing faces of the movable and stationary magnetic pole pieces between the stationary element 12 and the plunger 14, on the one hand, and between the plunger 14 and the yoke 10, on the other hand. FIG. 10(*a*) shows the position when the coil 18 is de-energized and FIG. 10(*b*) illustrates the plunger 14 as attracted upon energization of the coil 18. The plunger 14 is designed to move along and to be guided by a guide 44 made from a non-magnetic material.

In this embodiment, the inner face 10*a* of the yoke 10 and one magnetic pole face 14*a* of the plunger 14 are designed to face with each other parallel to the direction of movement of the plunger 14 while the other magnetic pole face 14*b* of the plunger 14 is designed to face perpendicular to the direction of movement of the plunger 14 with a magnetic pole face 14*c* which has a larger cross-sectional area than that of the stationary element 12. With this arrangement, it is possible to make the cross-sectional area of the stationary element 12 smaller as compared with the cross-sectional area of the abutment faces of the magnetic pole faces 14*c* and 14*b*, as long as magnetic saturation is not reached. As a result, the length of the coil required for the desired ampere-turn is reduced which, in turn, contributes to the reduction in the amount of copper wire used. Therefore, a compact, light weight, inexpensive electromagnet is provided which is simple in structure and is suitable for mass production.

The reasons therefor will be described below.

In a small-sized plunger-type electromagnet having an operating stroke in the order of several millimeters and an attractive force of less than 1 kg, it has been the general designing practice to ensure that the magnetic flux density at the operating gap is within the range of 0.2 to 0.6 $Wb/m^2$, in order to enable reasonable determination of the required magnetizing ampere-turn. As is well known, however, a value as large as 1.0 to 1.2 $Wb/m^2$ is permissible as the magnetic flux density for the core portion. In the conventional electromagnet shown in FIG. 22, however, since it is structurally required to design such that the cross-sectional area of the plunger 14 is roughly equal to the cross-sectional area of the stationary element 12, the magnetic flux density at the core portion is equal to the magnetic flux density at the operating gap and, hence, is in the order of 0.2 to 0.6 $Wb/m^2$. This value is 1/5 to ½ of the permissible magnetic flux density for the core portion. This means that it is possible to reduce the cross-sectional area of the core portion of 1/5 to ½. Alternatively, the abutment surface area of the magnetic pole faces 14*c* and 14*b* may be enlarged, with the cross-sectional area of the stationary element 12 unchanged. This enables to increase the magnetic flux density of the stationary element 12 and, hence, to increase the attractive force.

In addition, it will be noted that the surface area of the portion of the magnetic pole face 14*a* which faces the magnetic pole face 10*a* may be enlarged by increasing the axial length of the magnetic pole face 14*a*. The result of this is that the magnetic flux density at that portion is reduced, so that any unbalance of clearance between the plunger 14 and the yoke 10 is corrected. This minimizes the friction between the plunger 14 and the yoke 10 during movement of the plunger 14.

Figure 11:
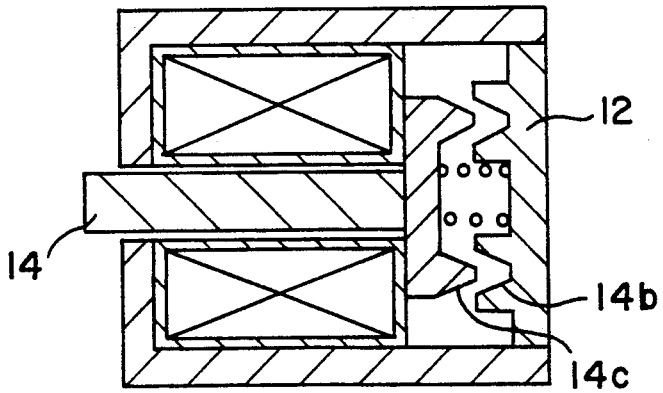
FIG. 11 is a cross-sectional view showing the second embodiment of the class of electromagnet shown in FIG. 10.

FIG. 11 illustrates a second embodiment of the electromagnet shown in FIG. 10. This embodiment is designed so that the abutment faces of the magnetic pole faces 14*b* and 14*c* in the embodiment shown in FIG. 10 are enlarged in order to generate a stronger attractive force.

Figure 12A:
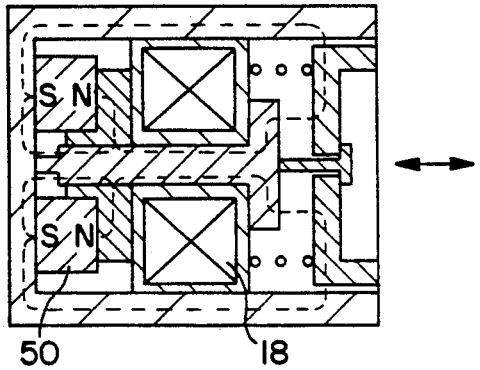
FIG. 12 is a cross-sectional view showing the third embodiment of the class of electromagnet shown in FIG. 10 in which embodiment a permanent magnet is added.
Figure 12B:
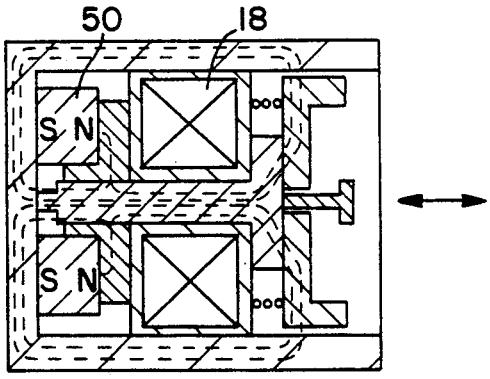

FIG. 12 illustrates a third embodiment of the electromagnet shown in FIG. 10. As shown, annular permanent magnet 50 is provided. A large attractive force is developed under the combined action of the magnetic flux due to energization of the coil 18 and the magnetic flux due to the annular permanent magnet 50. FIGS. 12(*a*) and 12(*b*) illustrate, respectively, the condition in which the coil 18 is de-energized and the condition in which it is energized.

Figure 13A:
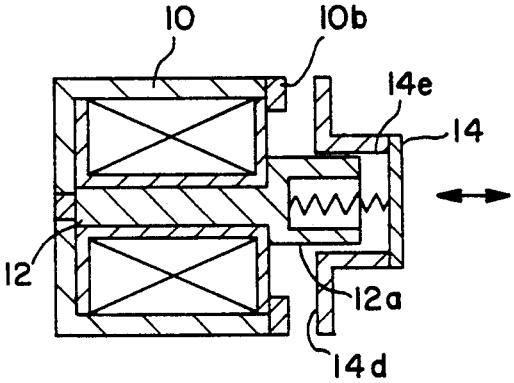
FIG. 13 is a cross-sectional view showing the first embodiment of the electromagnet of the class which is provided with the abutment face structure for the plunger and stationary element according to the invention.
Figure 13B:
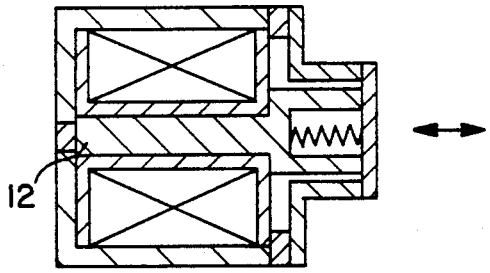

FIG. 13 illustrates another embodiment which is designed to enlarge the surface area of the opposing faces of the movable and stationary magnetic pole pieces between the stationary element 12 and the plunger 14, on the one hand, and between the plunger 14 and the yoke 10, on the other hand. As shown, the magnetic pole face located at the end face of the yoke 10, or the magnetic pole face 10*b* coupled to that end face, and one magnetic pole face 14*d* of the plunger 14 are arranged to face with each other perpendicular to the direction of movement of the plunger 14. The magnetic pole face 10*b* is designed to present a cross-sectional area larger than that of the stationary element 12. The magnetic pole face 12*a* of the stationary element 12 and the magnetic pole face 14*e* of the plunger 14 are arranged to face with each other parallel to the direction of movement of the plunger 14.

Although not shown, it will be readily understood for a person skilled in the art that, in the electromagnet shown in FIG. 13(*a*), the magnetic pole face 10*b* and the one magnetic pole face 14*d* of the plunger 14 may be designed and configured to form tapered projection and depression which fit with each other (cf. FIG. 11).

Figure 14A:
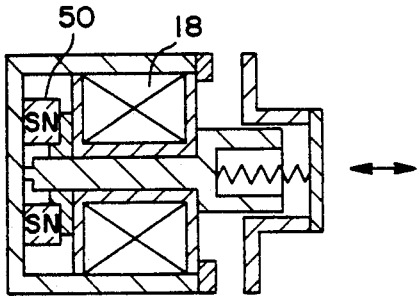
FIG. 14 is a cross-sectional view showing the second embodiment of the class of electromagnet shown in FIG. 13 in which embodiment a permanent magnet is added.
Figure 14B:
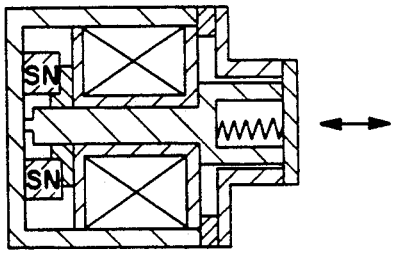

FIG. 14 illustrates another embodiment wherein an annular permanent magnet 50 is added to the embodiment shown in FIG. 13. A large attractive force is developed under the combined action of the magnetic flux due to energization of the coil 18 and the magnetic flux due to the annular permanent magnet 50.

It will be appreciated that, throughout the foregoing embodiments wherein a permanent magnet is employed, the permanent magnet is not situated in the middle of the travel of the plunger. This is of particular advantage because it is not necessary to divide the coil at both sides of the permanent magnet. Accordingly, it is possible to reduce the production cost.

Figure 15:
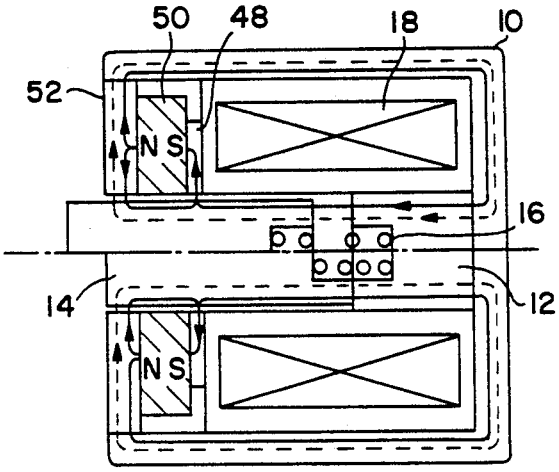
FIG. 15 is a cross-sectional view showing another embodiment of the electromagnet wherein an annular permanent magnet magnetized in the direction of thickness thereof is provided according to the invention.

FIG. 15 illustrates another embodiment of the invention. The permanent magnet 50 used in this embodiment differs from the annular permanent magnet 26 employed in the conventional electromagnet shown in FIG. 25, in that it is magnetized in the direction of thickness, instead of being magnetized in the radial direction. The permanent magnet 50 is shaped in the form of an annulus and is arranged coaxially with the plunger to surround the latter. In the illustrated embodiment, the annular permanent magnet 50 is disposed between the magnetic pole piece 52 of the yoke 10 and the annular magnetic pole piece 48 provided at the side of the coil 18 directed to the magnetic pole piece 52.

With this arrangement, the permanent magnet is not situated across the path of magnetic flux to be formed when the coil 18 is energized. It will also be noted that the annular magnetic pole piece 48 is arranged by making use of a space that would otherwise serve as a gap of the magnetic circuit. Accordingly, it is possible to reduce the magnetic reluctance.

Figure 16:
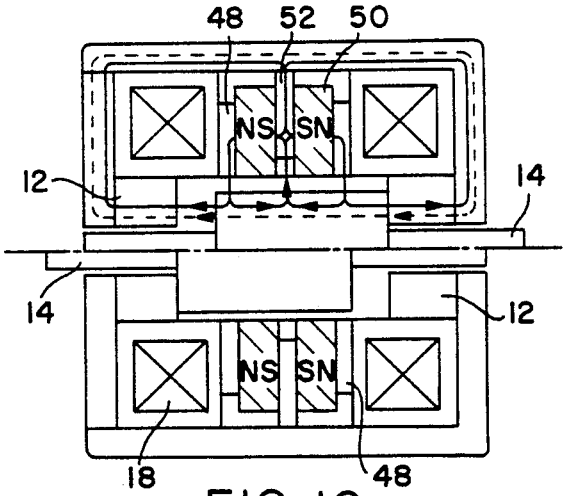
FIG. 16 is a cross-sectional view showing another embodiment wherein permanent magnets according to the invention are provided.

FIG. 16 shows another embodiment of the invention. Two such electromagnets as shown in FIG. 15 are combined symmetrically by being abutted with each other, with the magnetic pole piece 52 on the end face of the yoke 10 situated between the two. Two plungers are merged together to form a single common plunger. The ends of the common plunger 14 are reduced in diameter as compared with the central part. The stationary elements 12 at both ends are provided with a through aperture for moveably receiving the reduced diameter portions of the plunger. Upon energization of two coils 18, the plunger 14 will be attracted to one of the stationary elements 12 and will thereafter be retained in this magnetically stable position until electric current is supplied to the two coils 18 in the reverse direction to cause the plunger 14 to move toward and to be attracted by the other of the stationary elements 12. In this manner, this embodiment is magnetically bistable. Accordingly, it is possible to omit the conventional spring.

Figure 17:
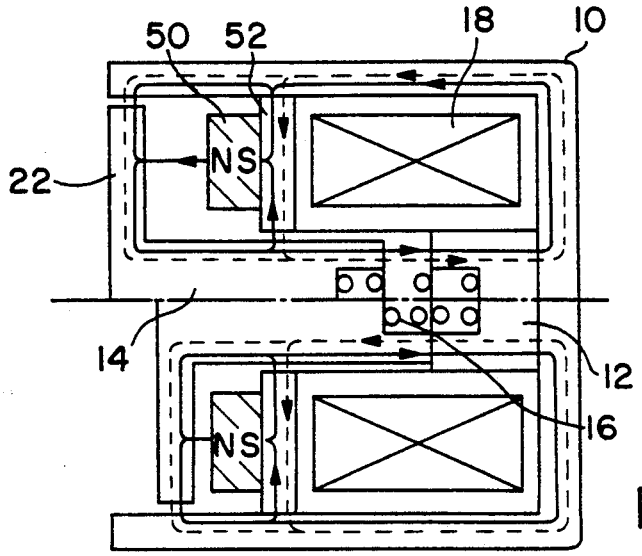
FIG. 17 is a cross-sectional view showing another embodiment wherein the permanent magnet and the attractive plate according to the invention are provided.

FIG. 17 illustrates an embodiment wherein an annular permanent magnet 50 and an attractive plate 22 are provided. The magnetic pole piece 52 at the end face of the yoke 10 is inserted within the yoke. The length of the plunger 14 is such that the face of the attractive plate 22 is brought into registration with the end face position of the yoke when the plunger 14 is not attracted to the stationary element 12. The annular permanent magnet 50 is arranged between the attractive plate 22 and the magnetic pole piece 52.

Figure 18:
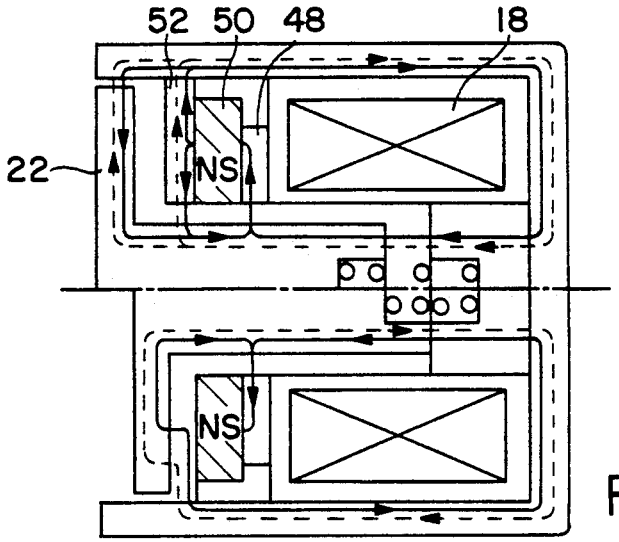
FIG. 18 is a cross-sectional view showing another embodiment of the electromagnet shown in FIG. 17.

FIG. 18 illustrates a second embodiment of the electromagnet provided with the annular permanent magnet 50 and the attractive plate 22. The annular permanent magnet 50 is positioned between the magnetic pole piece 52 and the coil 18, while the annular magnetic pole piece 48 is arranged between the annular permanent magnet 50 and the coil 18.

Figure 19:
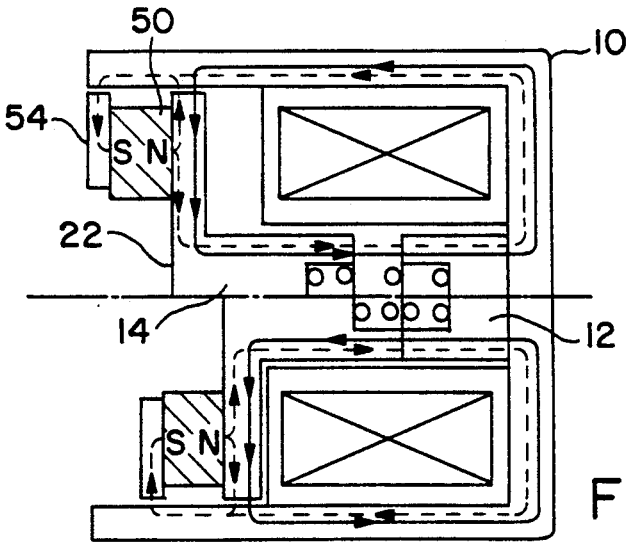
FIG. 19 is a cross-sectional view showing another embodiment wherein the permanent magnet according to the invention is mounted to the outer side of the attractive plate.
Figure 20A:
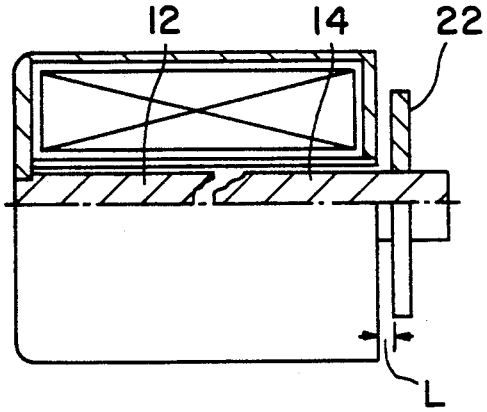
FIG. 20 is a view showing a working example of the invention.
Figure 20B:
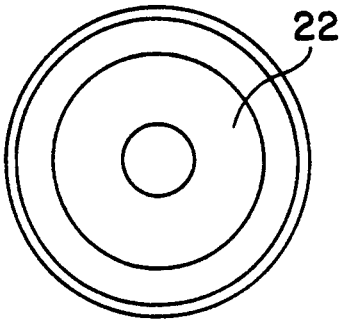
Figure 20C:
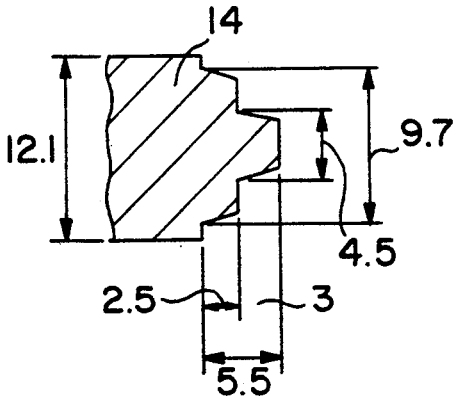
Figure 20D:
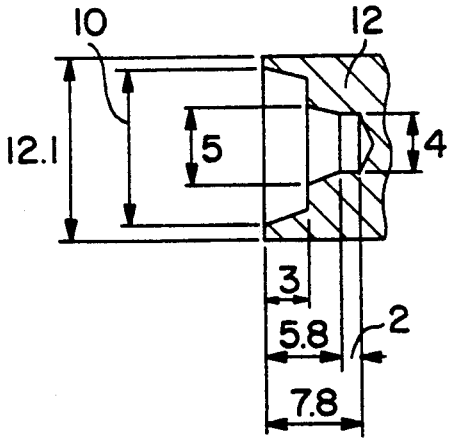

FIG. 19 illustrates another embodiment wherein the annular permanent magnet 50 is provided at the outer side of the attractive plate 22. The annular permanent magnet 50 and an annular magnetic pole piece 54 are mounted to the surface of the attractive plate 22. The length of the plunger 14 is such that the face of the annular magnetic pole piece 54 is brought into registration with the end face of the yoke 10 when the plunger 14 is not attracted to the stationary element 12.

It should be noted that, throughout the drawings of FIGS. 15, 17, 18 and 19, the upper half of the drawings indicates the plunger 14 as spaced away from the stationary element 12 and the lower half thereof illustrates the plunger 14 as attracted to the stationary element 12.

FIG. 20 shows a working example of the present invention. As shown, the attractive plate 22 is provided and the abutment faces of the stationary element 12 and of the plunger 14 are improved. FIG. 20(*a*) is a view thereof partly in cross-section, FIG. 20(*b*) is a plan view, FIG. 20(*c*) is a cross-sectional view of the plunger 14, and FIG. 20(*d*) is a cross-sectional view of the stationary element 12. In these drawings, the unit of dimension is expressed in mm. In this example, the distance of travel of the plunger 14 is 2.5 mm.

Figure 21:
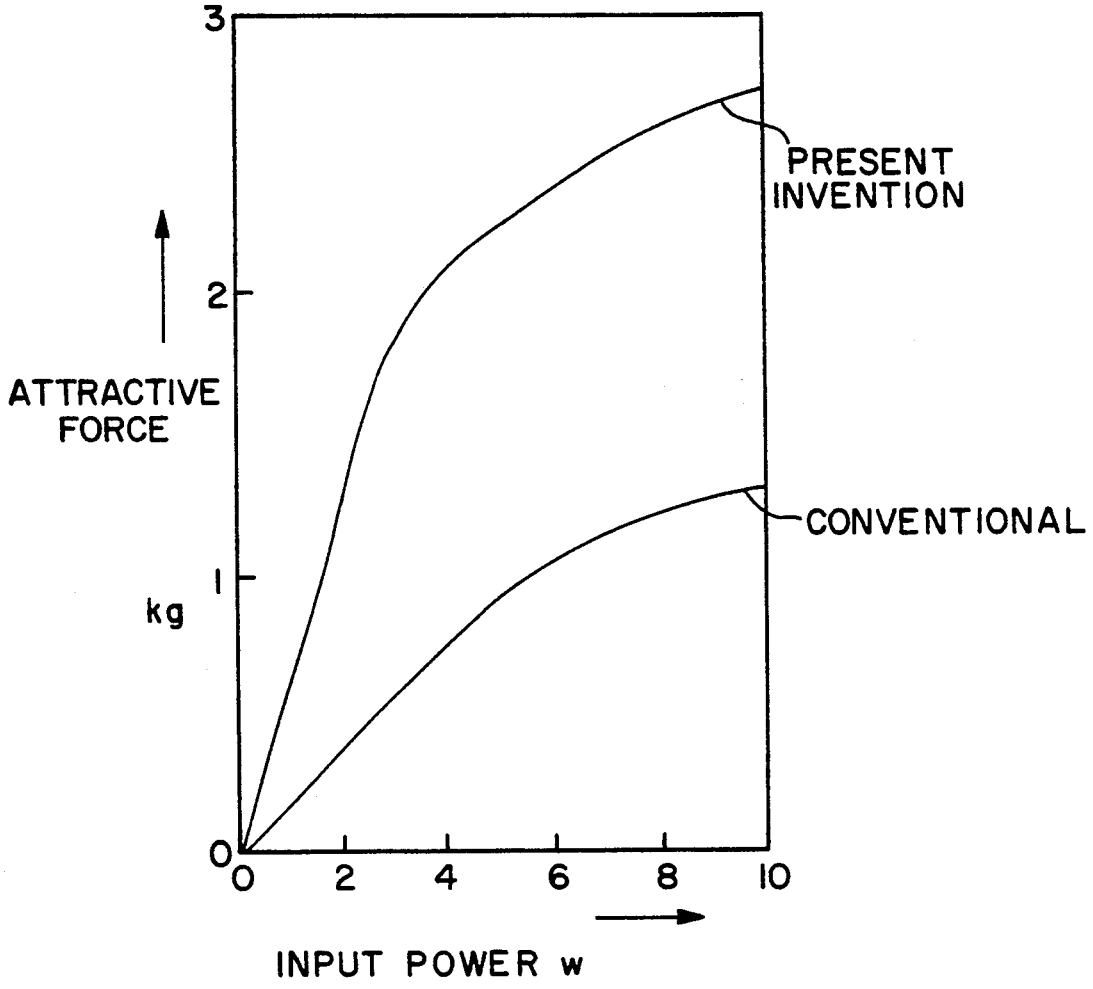
FIG. 21 is a graph showing the input and attractive force relationship of the electromagnet according to the invention as compared with that of the prior art; and, FIGS. 22–25 are cross-sectional views showing examples of the prior art electromagnet.

FIG. 21 is a graph showing the relationship between the input to the electromagnet and the attractive force, with respect to the working example of the invention shown in FIG. 20 and with respect to the conventional electromagnet having the same dimension but provided with neither an attractive plate nor an improved abutment face. It will be appreciated from the graph of FIG. 21 that according to the invention it is possible to obtain a greater attractive force with less input power as compared with the conventional device.

I claim:

1. A plunger type electromagnet comprising a yoke, a stationary element fixed to said yoke, a plunger having an end face adapted to be adhered to and released from said stationary element, a spring for biasing said plunger in a direction in which said end face is spaced away from said stationary element, a coil for magnetizing, upon energization, a magnetic circuit comprised of said stationary element, said plunger and said yoke and for attracting said plunger against the spring bias to cause it to adhere to said stationary element, a bobbin around which said coil is wound, and a permanent magnet for retaining said plunger to be adhered to said stationary element against the spring bias even when said coil is de-energized, characterized in that said electromagnet comprises: an attractive plate arranged at an end of said plunger opposite said stationary element in such manner as to intersect the plunger axis at a right angle and to inscribe the inner face of said yoke; said permanent magnet annular in form which is arranged coaxially with said attractive plate at the side of said attractive plate opposite said plunger and which is magnetized in the direction of thickness of the annulus; and, an annular magnetic pole piece arranged coaxially with said attractive plate at the side of said permanent magnet opposite said attractive plate, the length of said plunger being such that the face of said annular magnetic pole piece is brought into registration with the end face position of said yoke when said plunger is not attracted to said stationary element.

* * * * *